United States Patent [19]

Dobrjanskyj et al.

[11] 4,215,641

[45] Aug. 5, 1980

[54] ELECTRONIC CONTROL OF NEEDLE THREAD IN A SEWING MACHINE

[75] Inventors: Leo Dobrjanskyj, Flushing, N.Y.; Donald R. Simon, Wayne, N.J.

[73] Assignee: The Singer Company, Stamford, Conn.

[21] Appl. No.: 55,135

[22] Filed: Jul. 5, 1979

[51] Int. Cl.[2] ..... D05B 49/00; D05B 47/04

[52] U.S. Cl. ..... 112/278; 112/241; 112/255; 112/302

[58] Field of Search ..... 112/241, 242, 243, 244, 112/245, 254, 255, 278, 302

[56] References Cited

U.S. PATENT DOCUMENTS

| | | | |
|---|---|---|---|
| 2,584,013 | 1/1952 | Hagquist | 112/241 |
| 4,166,423 | 9/1979 | Brienza et al. | 112/278 X |

FOREIGN PATENT DOCUMENTS

| | | | |
|---|---|---|---|
| 53-31448 | 3/1978 | Japan | 112/255 |
| 53-31449 | 3/1978 | Japan | 112/241 |
| 53-79647 | 7/1978 | Japan | 112/302 |

*Primary Examiner*—Peter P. Nerbun

*Attorney, Agent, or Firm*—David L. Davis; Robert E. Smith; Edward L. Bell

[57] ABSTRACT

A sewing machine is provided with an actuator controlled thread take-up lever. A microprocessor is programmed to provide signals for controlling the actuator to provide a system wherein the interaction of the needle, the needle thread take-up and needle thread tension are optimally controlled. A thread metering mechanism, also under microprocessor control, is included in the system.

9 Claims, 5 Drawing Figures

ELECTRONIC CONTROL OF NEEDLE THREAD IN A SEWING MACHINE

DESCRIPTION

BACKGROUND OF THE INVENTION

This invention relates to sewing machines and, more particularly, to a sewing machine utilizing electronic intelligence for controlling the needle thread.

In a conventional sewing machine, the only control of the needle thread is the tension applied during the setting of a stitch. This tension control typically takes the form of a pair of discs between which the thread passes on its way from the supply of thread to the eye of the thread carrying needle. In particular, the tension discs are situated between the thread supply and the take-up lever, and are forced together with an amount of force determined by the position of an operator controlled tension setting dial. This conventional tension control arrangement possesses a number of disadvantages. For example, the operator typically sets the thread tension at some value which is a compromise value for a range of stitch sizes. Also, the frictional characteristics and thickness of thread utilized effects the ultimate thread tension in the above-described type of tension control arrangement. In any event, a certain amount of experimentation, depending upon the skill of the operator, is required to adjust the thread tension in order to maintain uniform stitch quality under varying conditions.

It is therefore an object of this invention to provide an improved thread tension control system.

It is another object of this invention to reduce the skill necessary to operate the sewing machine effectively.

In a conventional sewing machine, of the type described hereinabove, the needle thread dynamics of supply and tension are controlled by the action of a take-up lever in conjunction with a check spring and a tension control arrangement of the type described above. The take-up lever is typically coupled to perform reciprocatory motion in a fixed relation to the rotation of the sewing machine armshaft, and its motion does not vary from this fixed relation. The control of the thread which can be attained through the use of such an arrangement is therefore very limited.

It is therefore a further object of this invention to provide an arrangement for controlling the take-up lever.

In particular, it is an object of this invention to provide an improved needle thread control arrangement wherein the take-up lever is independently controlled to effect thread tension control.

SUMMARY OF THE INVENTION

The foregoing and additional objects are attained in accordance with the principles of this invention in combination with a sewing machine having a thread carrying needle adapted for endwise reciprocatory motion to penetrate a work fabric and cooperate with a looptaker in the formation of stitches, by providing an arrangement for controlling the needle thread comprising means for defining a thread path from a thread supply to the needle, a thread take-up lever positioned along the path and selectively movable in a defined range toward and away from the path, the thread take-up lever including means for slidably holding the thread, actuator means for moving the thread take-up lever within the defined range in accordance with take-up control signals applied thereto, thread clamping means interposed in the path between the supply and the take-up lever and responsive to clamp signals applied thereto for preventing movement of thread therethrough, and control means for generating the take-up control signals and the clamp signals in timed relation with the operation of the sewing machine.

In accordance with an aspect of this invention, the thread clamping means includes means for metering the thread used in the formation of a stitch.

In accordance with another aspect of this invention, the arrangement further includes means for sensing the thickness of the work fabric and providing a signal representative thereof to the control means, and means in the control means for utilizing the thickness signal to generate a signal for controlling the thread metering means.

BRIEF DESCRIPTION OF THE DRAWINGS

The foregoing will be more readily apparent upon reading the following description in conjunction with the drawings wherein.

DETAILED DESCRIPTION

Figure 1:
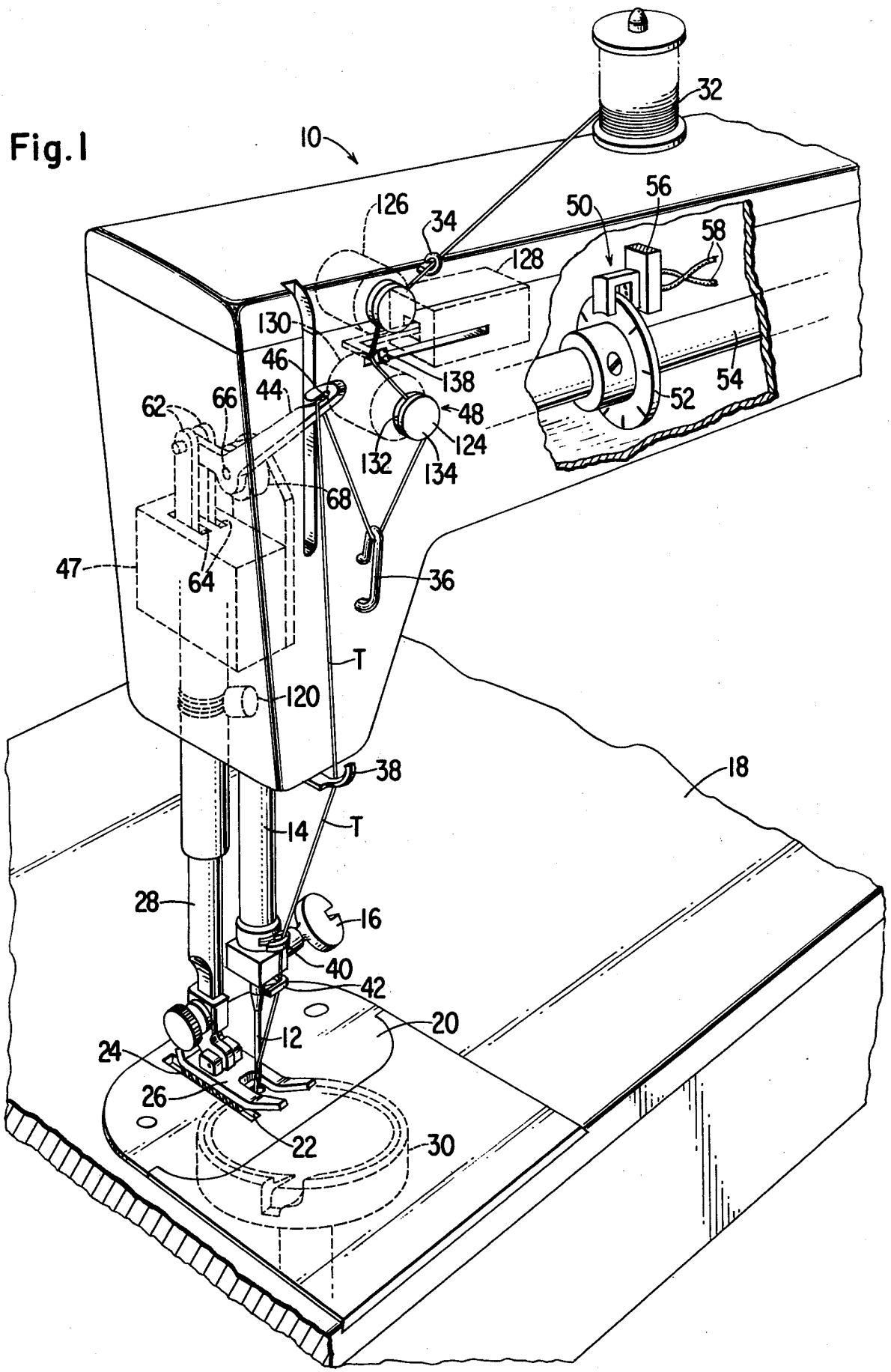
FIG. 1 is a perspective view, partially cut away, showing a portion of a sewing machine having incorporated therein apparatus constructed in accordance with the principles of this invention.

Referring now to the drawings, and particularly to FIG. 1 thereof, shown therein is a sewing machine, depicted generally at the reference numeral 10, including a thread carrying needle 12 connected to a needle bar 14 by means of a needle clamp 16, or the like. The needle bar 14 is adapted for endwise reciprocatory motion in a conventional manner. A work supporting surface 18 is provided with an opening covered by a throat plate 20 having slots 22 through which a feed dog 24 protrudes. A presser foot 26 is connected to a presser bar 28 to exert a downward force so as to provide for frictional engagement between a work fabric disposed beneath the presser foot 26 and the feed dog 24, in order to accomplish work transporting movement in a conventional manner. Beneath the work supporting surface 18 there is disposed a rotating looptaker 30. The reciprocatory motion of the needle bar 14 causes the thread carrying needle 12 to penetrate a work fabric and cooperate with the looptaker 30 to form stitches, in a conventional manner.

The thread T extends from a supply spool 32 to the needle 12 along a thread path defined by a plurality of thread guides 34, 36, 38, 40 and 42. A thread take-up lever 44 is positioned along the path and includes a slot 46 for slidably holding the thread. The thread take-up lever 44 is moved by an actuator 47 in a defined range toward and away from the thread path, as will be described in more detail hereinafter. The sewing machine 10 also includes a thread clamping arrangement 48, the details of which will be more fully described hereinafter, which is interposed in the thread path between the supply 32 and the take-up lever 44 and is responsive to signals applied thereto for clamping the thread T and preventing it from being drawn from the supply 32.

The thread handling system to be described is based upon the use of the actuator 47 to control the position of the take-up lever 44, and a servo amplifier whose gain is externally modified to control the force imparted by the actuator 47, through the take-up lever 44, to the needle thread T. The servo amplifier is part of a closed loop servo system for controlling and monitoring the position of the take-up lever 44. The servo system responds to input signals from a microprocessor, or other electronic intelligence. Since the system is a closed loop system, the actuator 47 seeks to move the take-up lever 44 to the position determined by the microprocessor irrespective of the thread environment (snagged, looped, or other) and one of the controlled variables in the system is the amount of force which the take-up lever 44 is permitted to exert on the thread T during each of the various stitch formation phases. This force corresponds to the thread tension. The actuator 47 can thus be programmed to apply forces almost great enough to snap the thread T in conditions where bobbin snagging might occur, and yet this force can be reduced to its proper level during stitch setting, by controlling the gain of the servo amplifier which determines the maximum amount of current which flows in the actuator 47. Since there is a direct transfer function between this actuator current and the maximum thread tension, an algorithm stored in the digital intelligence can compute or look up the desired tension profile, and implement it by controlling the gain of the servo amplifier.

The action of the thead take-up lever 44 is synchronized to the reciprocatory motion of the needle 12, the rotation of the looptaker 30 and the motion of the feed dog 24 through a time base provided by a position sensor assembly 50, illustratively including a timing disc 52 mounted on the sewing machine armshaft 54 and an optical encoder 56 cooperating with the timing disc 52 to provide signals over the leads 58 at spaced angular increments of rotation of the armshaft 54. In the described system, at different intervals of the stitch forming cycle, different actuator currents are available to cause motion of the take-up lever 44. In a first order approximation, the position of the thread take-up lever 44 is separated from the tension profile. The motion of the take-up lever 44 is programmed to follow the thread demand curve for the sewing machine 10 by comparing the position feedback signal to the programmed profile. In order to provide the proper thread tension, the amount of current supplied to the actuator 47 is regulated so that at the loop expansion region of the stitch forming cycle, no more than 20 grams of force can be supplied by the actuator, regardless of the servo system error signal. During the stitch setting portion of the stitch formation cycle, a maximum of 90 grams of force may be programmed. It is important to note that the programmed forces are independent of the frictional characteristics of the thread, and are under complete control of the microprocessor.

Figure 2:
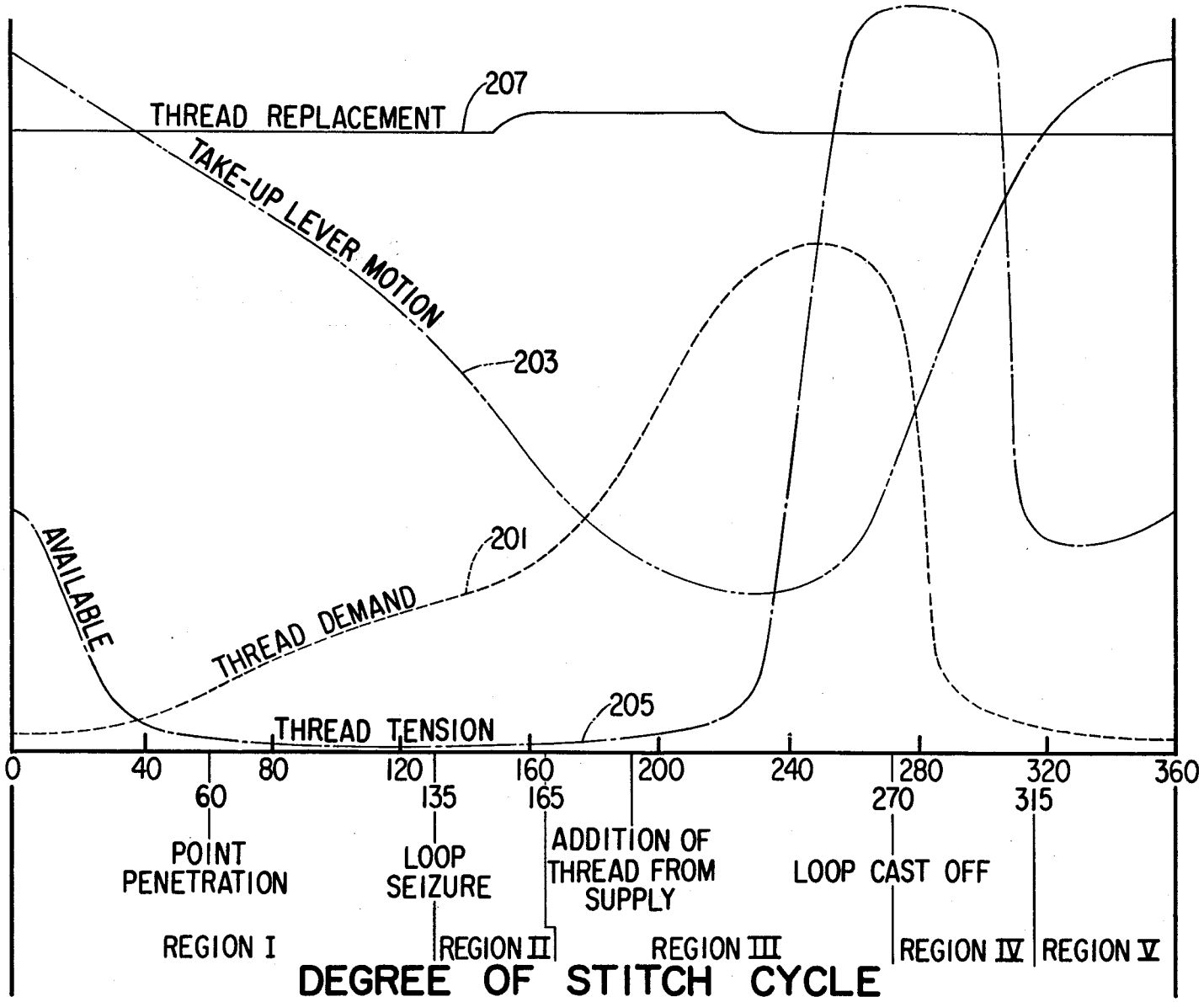
FIG. 2 is a set of curves illustrating dynamic characteristics of the sewing machine of FIG. 1 during a stitch forming cycle.

The resultant needle thread control system has various characteristics which are independent of the particular electronic control techniques employed. This will be explained with reference to the curves illustrating dynamic characteristics of the sewing machine 10 during the stitch forming cycle, as shown in FIG. 2. In order to more easily discuss the impact of the electronic control on the needle thread characteristics, the stitch forming cycle is considered to encompass 360° and is divided into five regions. Region I extends from 0° to 135° and is the region of downward needle and take-up lever motion starting with the take-up lever in its uppermost position and ending with the needle in its lowermost position. Region II extends from 135° to 165° and is the region of loop formation and seizure by the hook. Region III extends from 165° to 270° and is the region of loop expansion around the bobbin case. Region IV extends from 270° to 315° and is the region of loop contraction and extraction from under the throat plate. Region V extends from 315° to 360° and is the stitch setting region.

For the purpose of this discussion, it is assumed that the thread provided to the stitch forming mechanism exactly follows the thread demand curve 201. During Region I of the stitch forming cycle, the thread clamping arrangement 48 clamps the supply end of the thread T and the take-up lever 44 is in a quasi-stationary state near the peak of its motion, as shown by the take-up lever motion curve 203. No excess thread is supplied and the thread tension is reduced from the value necessary to set the previous stitch to a value, on the order of 5 grams, necessary to provide sliding motion of the eye of the needle 12 over the thread T. The magnitude of the tension is controlled by controlling the maximum available servo current in response to an error signal. During penetration, the take-up lever 44 moves downwardly, beginning to supply the necessary thread to the stitch forming system. Movement of the actuator 47 is permitted to occur only within the allowable thread tension constraints for Region I, by limiting the actuator current to that value correlated to the tension value, the available thread tension being shown in curve 205 of FIG. 2.

During Region II, thread is continuing to be supplied to the stitch forming mechanism at a moderate rate to permit the formation of a loop below the throat plate 20. The allowable tension, however, is still held to a low value. Loop seizure, occurring near the end of Region II, marks the onset of a more rapid thread take-up lever movement in order to start supplying the increased thread flow related to loop expansion. Region III signifies the loop expansion around the bobbin. During this loop expansion, the needle thread is allowed to flow from the supply and replenish the thread used during the previous stitch cycle. Thread replacement is illustrated by curve 207 in FIG. 2. The amount of thread in the system from the clamping arrangement 48, through the take-up lever 44, the needle 12 and to the previous stitch is held constant during the Regions I, II and IV. Thread replenishment can be accomplished in either a free demand type system or by a thread metering mechanism. These will be described in more detail hereinafter.

In Region IV the loop is being extracted from the bobbin assembly, and the thread take-up lever 44 moves rapidly upward, pulling the thread through its prescribed pathway. A consistent problem during this portion of the stitch forming cycle is the occurrence of snagging of the thread loop on the bobbin system. If this occurs, thread is normally stolen from the supply and an improper stitch results. However, in the described system, this region is marked with both a high rate of thread take-up lever motion and a large amount of power potential to the actuator 47. If the thread were to snag, the actuator 47 could produce thread tension to a level just below that of the breaking point of the thread, in order to overcome the thread stealing phenomenom. The tension levels are significantly higher during this period than those normally available for setting the stitch, and are sufficient to eliminate most problems associated with needle thread snagging.

In Region V, the maximum tension setting is that necessary to set the stitch properly, and is approximately 90 grams. One way this can be determined without sensing the bobbin thread tension, is to have the operator sew a test sample and another way is to enter the proper setting into the microprocessor memory through a control panel on the sewing machine. If the bobbin tension is measured, then the gain can be preset electronically. Once the reference stitches have been sewn or the system gain adjusted and entered, the tension algorithm stored in the microprocessor can automatically compensate for speed and stitch caused variations.

Figure 3:
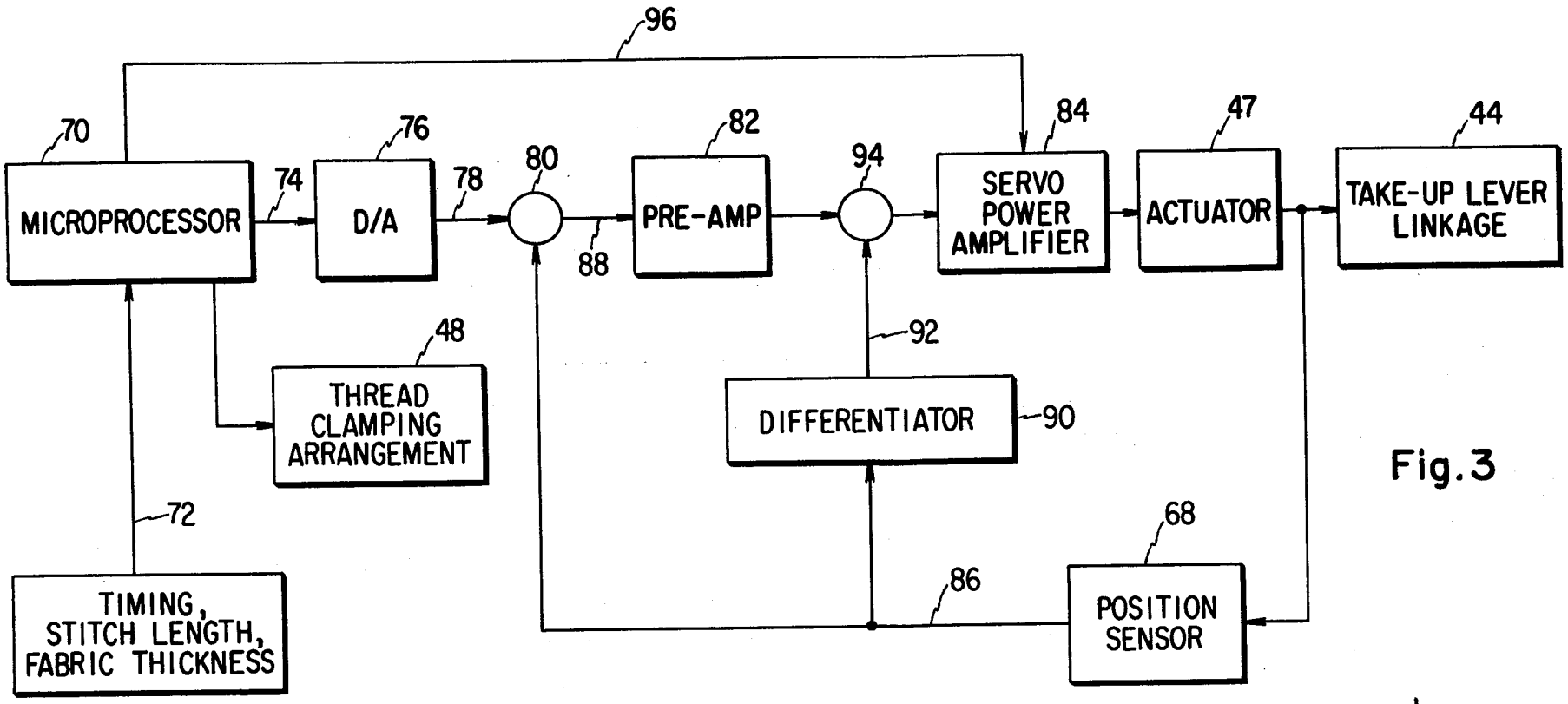
FIG. 3 depicts a schematic block diagram of a control system for the take-up lever actuator, which control system operates in accordance with the principles of this invention.

Referring now to FIG. 3, shown therein is a block schematic diagram for controlling the needle thread T by providing signals for controlling the actuator 47 and the thread clamping arrangement 48. The actuator 47 is illustratively a linear motor of the type described in U.S. Pat. No. 4,016,441, the contents of which are hereby incorporated by reference herein. As described in the referenced patent, the actuator 47 has a pair of connecting arms 62 extending outwardly from the actuator 47 through a pair of clearance apertures 64. The connecting arms 62 are coupled to the take-up lever 44 which is adapted for pivoting movement about a pivot point 66. A rotary potentiometer 68 has its control element connected to the take-up lever 44 at the pivot point 66 so that pivotal motion of the take-up lever 44 is converted to rotary motion of the control element of the potentiometer 68. The potentiometer 68 is thus used to provide electrical signals indicative of the position of the take-up lever 44.

The take-up lever position is controlled by a microprocessor 70 which provides signals to a servo system which controls the actuator 47. The microprocessor 70 is programmed with an algorithm for providing signals corresponding to the take-up lever motion curve 203 (FIG. 2). The microprocessor receives timing signals, as well as other signals to be described in more detail hereinafter, over the leads 72 from the position sensor assembly 50. Utilizing the timing signals, the microprocessor 70 provides an output signal over the lead 74 to the digital-to-analog converter 76. Illustratively, the signal on the lead 74 is a pulse width modulated digital signal having an on/off ratio corresponding to the desired position of the take-up lever 44. The digital-to-analog converter 76 operates on the signal on the lead 74 in a conventional manner (for example as by integration thereof) to provide a signal on the lead 78 which has a voltage level representing the desired position of the take-up lever 44. This signal is connected to the summing point 80 of a low level preamplifier 82 forming the first stage of a servo amplifier system. The preamplifier 82 drives a servo power amplifier 84 which supplies direct current of reversible polarity to the actuator 47 to position the actuator 47 in accordance with the input analog voltage on the line 78. The position sensor 68, which is mechanically coupled to the actuator 47, provides a feedback position signal on the line 86 indicative of the existing output position. The input analog voltage and the feedback signal are algebraically summed at the summing point 80 to supply an error signal on the line 88. The feedback signal from the position sensor 68 is also differentiated with respect to time in a differentiator 90 and the resulting rate signal is presented on the line 92 to the summing point 94 of the servo power amplifier 84 to modify the positional signal at that point. The position sensor 68 may be any device that generates an analog voltage proportional to position and, as described earlier, is illustratively a rotary potentiometer. This potentiometer is connected to a stable reference voltage and functions as a voltage divider. The above-described system will attempt to position the take-up lever 44 to follow the take-up lever motion curve 203. The amount of force which can be generated to move the take-up lever 44 will translate directly into thread tension, which should follow thread tension curve 205. The microprocessor 70 is programmed internally with the thread tension curve 205 and provides appropriate signals over the leads 96 to the servo power amplifier 84 to control the maximum current potential of the servo power amplifier 84, and limits the available drive currents to those which cannot cause forces in excess of those desired.

Figure 4:
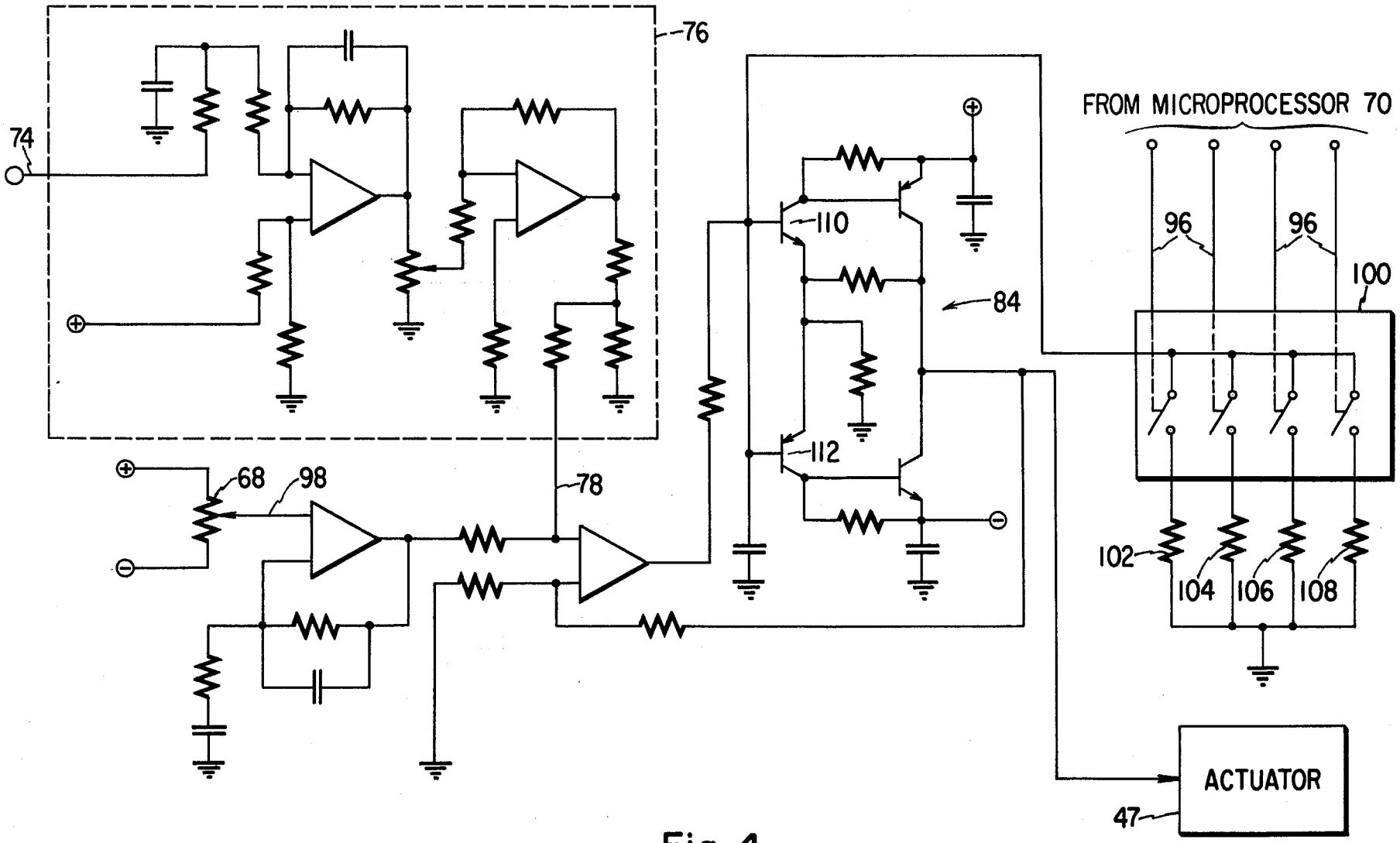
FIG. 4 is a schematic circuit diagram showing details of a portion of the system shown in FIG. 3.

FIG. 4 illustrates details of a portion of the system shown in FIG. 3 and provides an example of how the system may be implemented to control the position of the take-up lever 44 and the force which may be exerted to control the thread tension. The desired position of the take-up lever 44 is provided in the form of a digital signal on the lead 74 from the microprocessor 70. The digital-to-analog converter 76 converts this signal to an analog voltage on the lead 78. The actual position of the take-up lever 44 is provided in the form of a voltage on the lead 98 from the control element of the position sensor 68 acting as a voltage divider. The servo power amplifier 84 provides drive signals for the actuator 47, as described above. The amount of force which the actuator 47 can generate in moving to the specified position is controlled by the analog switches 100 whose closure is determined by signals from the microprocessor 70 over the leads 96. In the closed position of the analog switches 100, the appropriate resistor 102, 104, 106, 108, is connected in circuit with the servo power amplifier 84 and determines the maximum current feed to the transistors 110 and 112 therein. This then determines the maximum amount of force which the actuator 47 can generate, by the limited current available to it.

Figure 5:
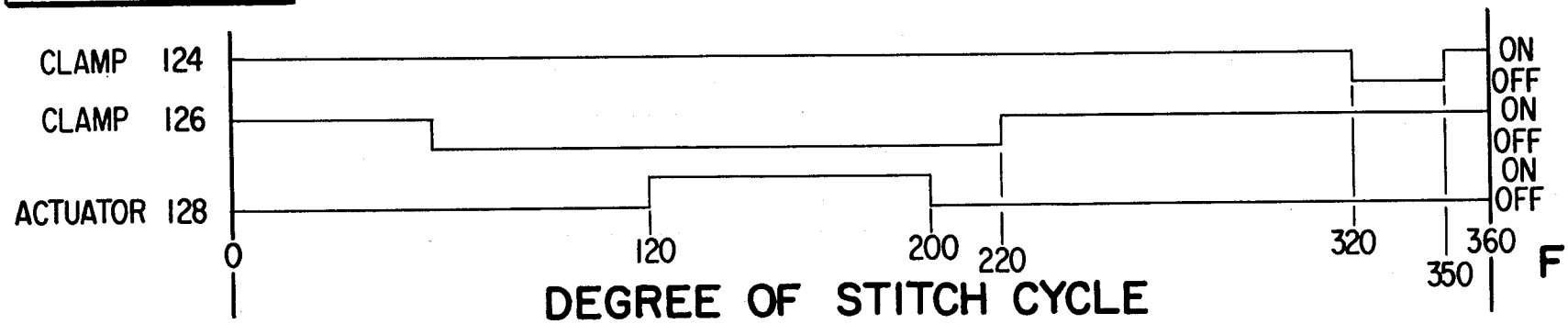
FIG. 5 is an illustrative timing chart for operating the thread clamping arrangement shown in FIG. 1.

The microprocessor 70 also controls the operation of the thread clamping arrangement 48. The thread clamping arrangement 48 illustrated in FIG. 1 also includes a thread metering mechanism. A position sensor 120 measures the height of the presser bar above the throat plate and provides a signal over the leads 72 to the microprocessor 70 which is indicative of the thickness of the work fabric being sewn. The position sensor 120 may be of any conventional design such as, for example, magnetic with hall effect sensing devices or optical. The microprocessor 70 also receives an input over the leads 72 reflecting the stitch length. This signal may be generated from either a stitch length setting device on the sewing machine or from a stitch pattern control system, such as that described in U.S. Pat. No. 3,872,808, the contents of which are hereby incorporated by reference herein, wherein the stitch length may be calculated from the bight and feed increments stored in the pattern memory. In any event, the fabric thickness and stitch length signals over the leads 72 are combined by the microprocessor 70 to determine the amount of thread to be metered for the stitch being formed. Accordingly, the thread clamping arrangement 48 includes a first thread clamp 124, a second thread clamp 126 and a thread metering actuator 128. The first thread clamp 124 is downstream from the second thread clamp 126, in the direction of thread flow, and the thread metering actuator is interposed therebetween. Illustratively, the thread clamp 124 includes a solenoid 130 and a pair of high friction clamp discs 132 and 134 between which the thread T passes. Upon energization of the solenoid 130, the clamp discs 132 and 134 are forced together to prevent the thread from moving therethrough. The thread clamp 126 is similarly constructed. The thread metering actuator 128 may illustratively comprise a linear motor of the same type as the actuator 47, having its connecting arms connected to an arm 138. To meter the appropriate amount of thread T, thread clamp 124 is energized, thread metering actuator 128 is caused to move arm 138 to the left to draw out the appropriate amount of thread from the supply 32, thread clamp 126 is then energized, and thread clamp 124 is deenergized. Illustrative timing of these events is shown in FIG. 5 from which it is seen that the actuator 128 is operative during the time that the first clamp 124 is energized and the second clamp 126 is deenergized. Both thread clamps 124, 126 are energized during the period of maximum thread tension and then after the stitch is set the clamp 124 is deenergized to allow the thread drawn by the actuator 128 to pass to the system to replenish the thread used in the formation of the stitch. Alternatively, a free demand type thread clamping arrangement may be utilized, such an arrangement including only a single thread clamp 124 or 126 without a thread metering actuator.

Accordingly, there has been described an improved needle thread control arrangement for a sewing machine. It is understood that the above-described embodiment is merely illustrative of the application of the principles of this invention. Numerous other embodiments may be devised by those skilled in the art without departing from the spirit and scope of this invention, as defined by the appended claims.

We claim:

1. In combination with a sewing machine having a thread carrying needle adapted for endwise reciprocatory motion to penetrate a work fabric and cooperate with a looptaker in the formation of stitches, an arrangement for controlling the needle thread comprising:

means for defining a thread path from a thread supply to said needle;

a thread take-up lever positioned along said path and selectively movable in a defined range toward and away from said path, said thread take-up lever including means for slidably holding said thread;

actuator means for moving said thread take-up lever within said defined range in accordance with take-up control signals applied thereto;

thread clamping means interposed in said path between said supply and said take-up lever and responsive to clamp signals applied thereto for preventing movement of thread therethrough; and control means for generating said take-up control signals and said clamp signals in timed relation with the operation of said sewing machine.

2. The arrangement according to claim 1 wherein said thread clamping means includes thread metering means for pulling a measured amount of thread from said thread supply.

3. The arrangement according to claim 2 wherein said thread clamping means includes a first thread clamp and a second thread clamp, and said thread metering means is interposed between said first and second thread clamps.

4. The arrangement according to claim 3 wherein said first thread clamp is downstream of said second thread clamp and said control means includes means for deactivating said second thread clamp and activating said first thread clamp during the time said thread metering means is operative and then subsequently activating said second thread clamp and deactivating said first thread clamp, whereby said measured amount of thread is available to said needle.

5. The arrangement according to claim 2 further including:

means for sensing the thickness of the work fabric and providing a signal representative thereof to said control means; and means in said control means for utilizing said thickness signal to generate a signal for controlling said thread metering means.

6. The arrangement according to claim 1 wherein said actuator means includes controllable means for selectively varying the maximum force available to move said thread take-up lever and said control means includes means for controlling the operation of said controllable force varying means, whereby thread tension is controlled.

7. The arrangement according to claim 1 wherein said actuator means includes a linear motor and a positioning servo system coupled between said control means and said linear motor.

8. The arrangement according to claim 7 wherein said control means includes means for controlling said servo system to control the amount of current available to drive said linear motor.

9. The arrangement according to claim 1 wherein said control means includes means for generating said take-up control signals in accordance with a stored positioning algorithm and a stored force algorithm.

* * * * *